US006833551B2

(12) United States Patent
Avnery

(10) Patent No.: US 6,833,551 B2
(45) Date of Patent: Dec. 21, 2004

(54) ELECTRON BEAM IRRADIATION APPARATUS

(75) Inventor: Tzvi Avnery, Winchester, MA (US)

(73) Assignee: Advanced Electron Beams, Inc., Wilmington, MA (US)

( * ) Notice: Subject to any disclaimer, the term of this patent is extended or adjusted under 35 U.S.C. 154(b) by 0 days.

(21) Appl. No.: 10/097,192

(22) Filed: Mar. 12, 2002

(65) Prior Publication Data

US 2002/0149321 A1 Oct. 17, 2002

Related U.S. Application Data

(60) Provisional application No. 60/277,399, filed on Mar. 20, 2001.

(51) Int. Cl.[7] ..... G21G 4/00
(52) U.S. Cl. ..... 250/492.3; 250/492.1
(58) Field of Search ..... 250/492.1, 492.3, 250/400

(56) References Cited

U.S. PATENT DOCUMENTS

| | | | | |
|---|---|---|---|---|
| 3,433,947 A | | 3/1969 | Emanuelson et al. | 250/49.5 |
| 3,780,308 A | | 12/1973 | Nablo | 250/492 |
| 3,833,814 A | | 9/1974 | Nablo | |
| 4,020,354 A | | 4/1977 | Fauss et al. | 250/492 |
| 4,246,297 A | | 1/1981 | Nablo et al. | 427/44 |
| 4,652,763 A | | 3/1987 | Nablo | 250/492.3 |
| 4,915,916 A | | 4/1990 | Ito et al. | 422/186 |
| 5,378,898 A | | 1/1995 | Schonberg et al. | 250/492.3 |
| 5,382,802 A | * | 1/1995 | Anabuki et al. | 250/492.1 |
| 5,414,267 A | | 5/1995 | Wakalopulos | 250/492.3 |
| 5,434,421 A | * | 7/1995 | Burth et al. | 250/434 |
| 5,709,842 A | | 1/1998 | Held et al. | 422/292 |
| 6,140,657 A | | 10/2000 | Wakalopulos et al. | 250/492.3 |
| 6,188,075 B1 | * | 2/2001 | Takayama et al. | 250/492.3 |
| 6,239,543 B1 | * | 5/2001 | Wakalopulos | 313/420 |
| 6,306,468 B1 | | 10/2001 | Maddox et al. | 427/500 |
| 2001/0035500 A1 | | 11/2001 | Schianchi et al. | |

FOREIGN PATENT DOCUMENTS

| | | | |
|---|---|---|---|
| DE | 1 010 658 | 6/1957 | |
| DE | 100 51 109 C1 | 4/2002 | B01J/19/12 |
| EP | 0 037 869 A1 | 10/1981 | H01B/13/06 |
| GB | 1 277 253 | 6/1972 | B01J/1/10 |
| GB | 1 389 080 | 4/1975 | H01J/33/10 |
| WO | WO 01/00249 A1 | 1/2001 | A61L/2/08 |

* cited by examiner

*Primary Examiner*—John R. Lee
*Assistant Examiner*—Paul M. Gurzo
(74) *Attorney, Agent, or Firm*—Hamilton, Brook, Smith & Reynolds, P.C.

(57) ABSTRACT

An electron beam irradiation apparatus includes an electron beam system for directing electrons into an irradiation zone. The electron beam system and the irradiation zone are configured for irradiating outwardly exposed surfaces of a 3-dimensional article passing through the irradiation zone from different directions with the electrons from the electron beam system.

46 Claims, 9 Drawing Sheets

ELECTRON BEAM IRRADIATION APPARATUS

RELATED APPLICATION

This application claims the benefit of U.S. Provisional Application No. 60/277,399, filed on Mar. 20, 2001. The entire teachings of the above application are incorporated herein by reference.

BACKGROUND

Profiled products such as metallic tubing, structural profiles, etc., are typically manufactured in a continuous manner. Common methods of manufacturing include continuous extrusion or casting processes, as well as continuous bending, or bending and welding of a single moving ribbon of sheet stock. At the end of the manufacturing process, the product is cut into the desired lengths. Some products are given a protective or decorative coating, for example, paint, before being cut into lengths. This typically requires a coating station for coating the continuously moving product and an extremely lengthy curing oven for drying or curing the coating. The curing oven can be as long as 100 to 300 feet, which significantly increases the length and cost of the manufacturing line.

SUMMARY

The present invention provides an electron beam irradiation apparatus which can be employed for curing coatings on articles, such as a continuously moving profile, without the aid of a curing oven. The electron beam irradiation apparatus of the present invention includes an electron beam system for directing electrons into an irradiation zone. The electron beam system and the irradiation zone are configured for irradiating outwardly exposed surfaces of a 3-dimensional article passing through the irradiation zone from different directions with the electrons from the electron beam system.

In preferred embodiments, the electron beam system includes multiple electron beam emitters which are positioned to irradiate the irradiation zone with electrons, each from a different direction. In some embodiments, the electron beam system includes four electron beam emitters which are positioned in first and second opposed pairs. The second opposed pair can be positioned downstream from the first opposed pair. An adjustment system is included for changing the position of the electron beam emitters relative to the irradiation zone. The adjustment system can include an adjustable linear mechanism capable of moving the electron beam emitters towards or away from the irradiation zone, and an adjustable rotating mechanism capable of rotating the electron beam emitters about the irradiation zone. A conveyance system is included for conveying the article through the irradiation zone. The conveyance system is configured to allow the article to be irradiated with electrons on the outwardly exposed surfaces. In situations where the article is a continuous profile, the conveyance system includes at least one roller positioned beyond the irradiation zone for conveying the profile through the irradiation zone. Other embodiments of the electron beam system can sterilize or provide surface modification of the surfaces of the article.

In another embodiment, the electron beam system includes two opposed electron beam emitters separated from each other by a gap which provides electrons from opposing directions. The conveyance system includes two conveyor belts for conveying the article between the opposed electron beam emitters and through the gap therebetween. The conveyor belts are spaced apart from each other in the region of the gap so that the article passing between the electron beam emitters can be fully irradiated by the electrons. Such an embodiment can be employed for sterilizing articles such as medical instruments.

The present invention is also directed to an electron beam irradiation apparatus including an electron beam system having multiple electron beam emitters for directing electrons into an irradiation zone. The electron beam system and the irradiation zone are configured for irradiating an article passing through the irradiation zone with electrons from the electron beam system. An adjustment system changes the position of the electron beam emitters relative to the irradiation zone.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
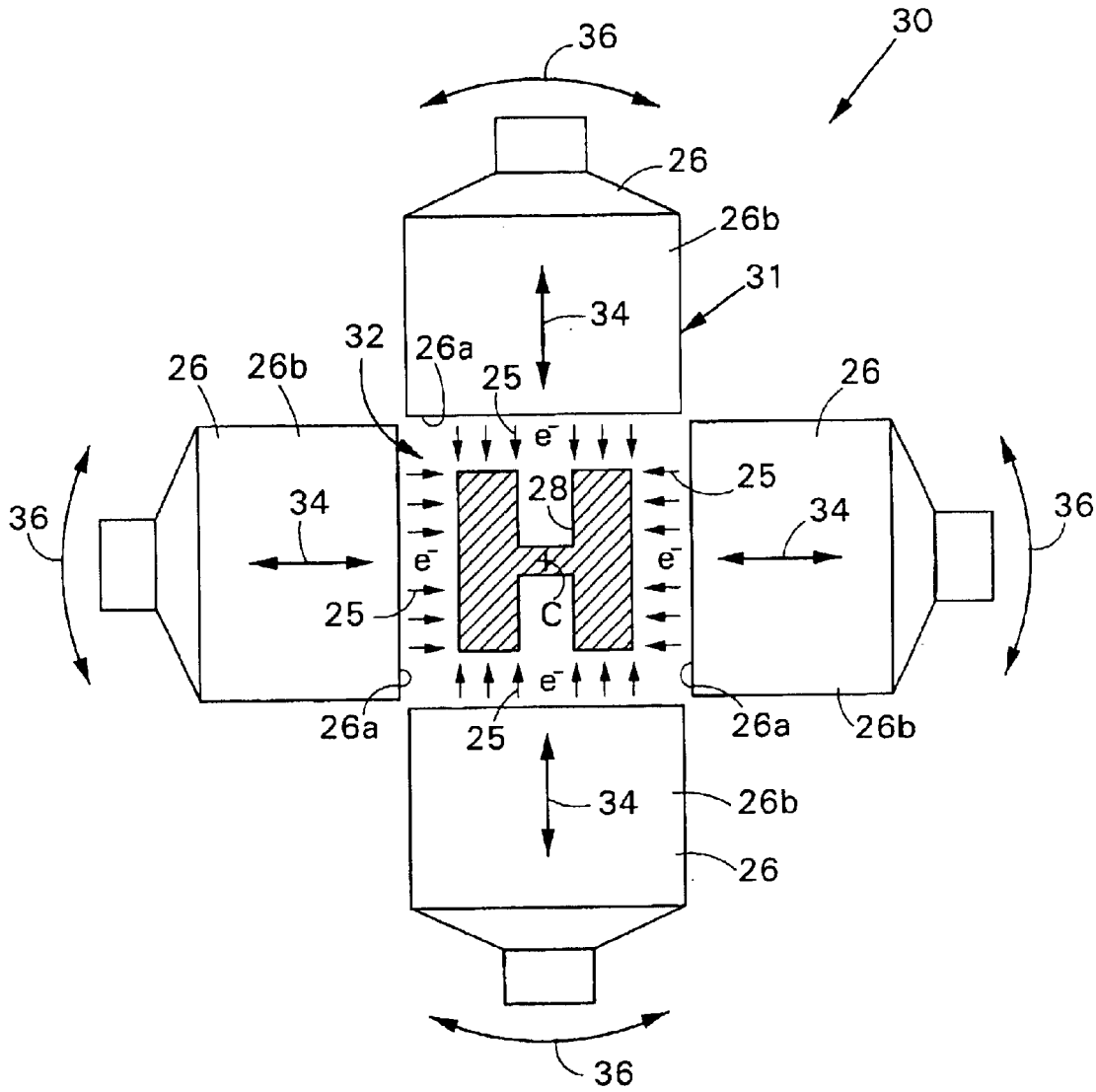
FIG. 1 is an end schematic view of an embodiment of the present invention electron beam irradiation apparatus, irradiating a 3-dimensional profile with electrons.
Figure 2:
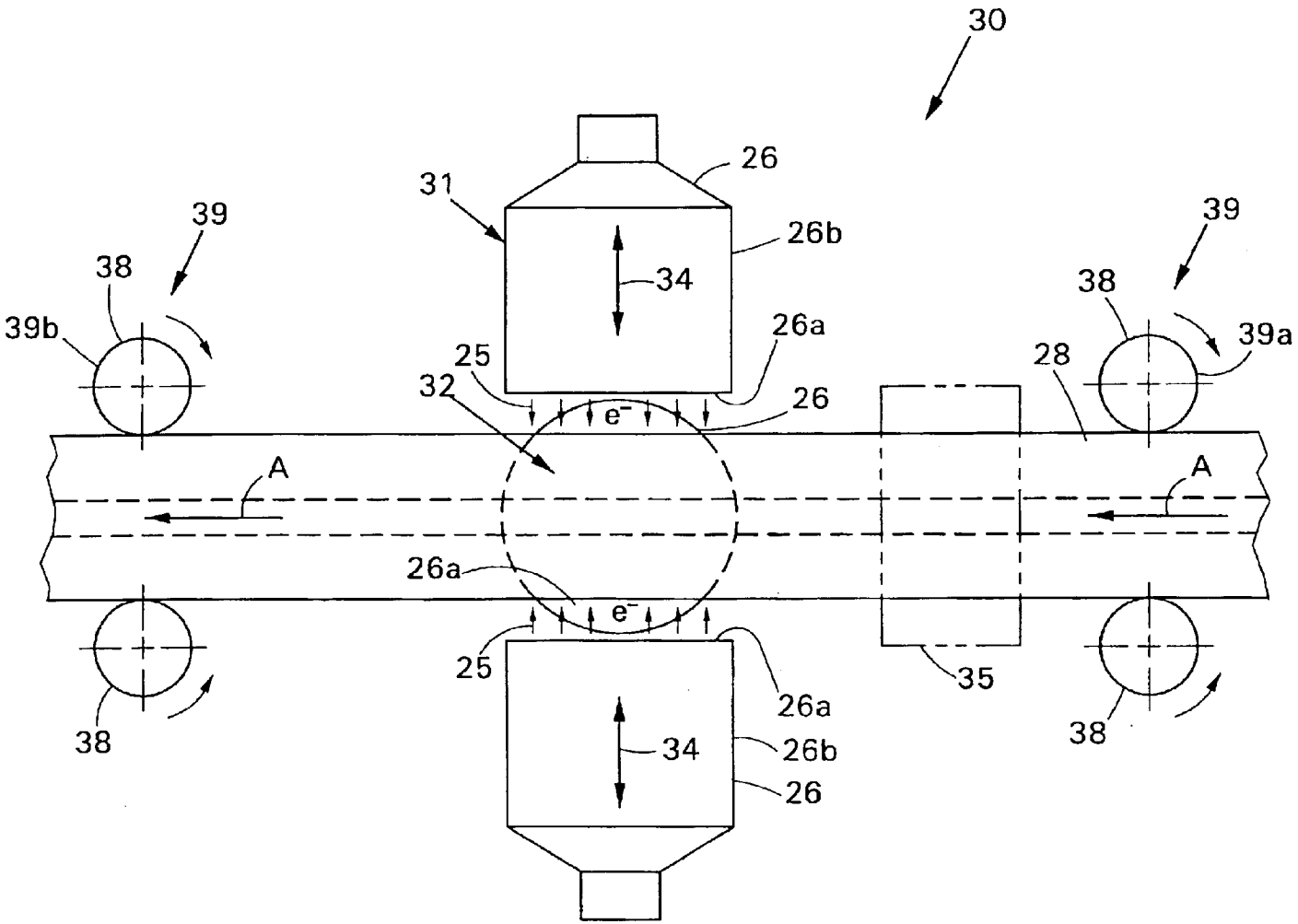
FIG. 2 is a side schematic view of the electron beam irradiation apparatus of FIG. 1 with one of the electron beam emitters omitted for clarity.

Referring to FIGS. 1 and 2, electron beam irradiation apparatus 30 is suitable for irradiating a continuously moving 3-dimensional profiled article 28 with electrons along a manufacturing line, for example, tubing, structural profiles, etc. Article 28 may be metal, plastic, etc. and is shown in FIG. 1 as a continuously extruded H-shaped cross section as an example. Irradiation apparatus 30 is typically employed for curing electron beam curable coatings on article 28 such as ink, protective coatings, paint, etc., applied by a coating station 35 (FIG. 2). Coating station 35 typically sprays the coating on article 28, but alternatively, may apply the coating by other suitable methods.

Irradiation apparatus 30 includes an electron beam emitter system 31 having multiple (more than one) electron beam emitters 26 which are positioned around an irradiation region or zone 32. Each electron beam emitter 26 includes a vacuum chamber 26*b* within which an electron gun is positioned for generating electrons $e^-$. The electrons $e^-$ are accelerated out from the vacuum chamber 26*b* through a thin foil exit window 26*a* in an electron beam 25 into irradiation region 32. Electron beam emitters 26 may be similar to those described in U.S. application Ser. No. 09/209,024, filed Dec. 10, 1998, and Ser. No. 09/349,592, filed Jul. 9, 1999, the contents of which are incorporated herein by reference in their entirety. The electron beam emitters 26 are positioned relative to each other so that the beams 25 of electrons $e^-$ generated by emitters 26 through exit windows 26*a* are able to irradiate the outwardly exposed surfaces of article 28 while article 28 moves through irradiation region 32 to provide about 360° of electron beam coverage around article 28. In the embodiment depicted in FIGS. 1 and 2, electron beam emitter system 31 includes four electron beam emitters 26 for irradiating article 28 with beams 25 of electrons $e^-$ from four different directions. For articles 28 having right angled corners, adjacent emitters 26 are usually oriented at right angles to each other as shown in FIG. 1. In the embodiment shown in FIG. 1, electron beam emitters 26 are positioned around irradiation region 32 along a common plane and in two opposed pairs which are at right angles to each other. Each electron beam emitter 26 is capable of being moved towards or away from irradiation region 32 in the direction of arrows 34 with an adjustable linear mechanism in order to adjust to varying sizes, orientations and shapes of article 28. In addition, each electron beam emitter 26 may be rotated about the center C of irradiation region 32 in the direction of arrows 36 (FIG. 1) with an adjustable rotating mechanism to provide further adjustment. In one embodiment, each electron beam emitter 26 is rotated independently from the other. In another embodiment, the electron beam emitters 26 can be rotated in unison. The electron beam emitters 26 can be rotated by a single mechanism or each by a separate mechanism.

Article 28 is moved through irradiation region 32 in the direction of arrows A by a conveyance system 39 having upstream 39*a* and downstream 39*b* portions which typically includes a series of rollers 38 (FIG. 2) for driving and/or guiding article 28. The rollers 38 may be paired as shown or can consist of a single bottom support roller 38 at the upstream 39*a* and downstream 39*b* portions of conveyance system 39. The conveyance system 39 can also include tractor belts.

In use, referring to FIG. 2, after article 28 is formed, article 28 is continuously guided and/or driven through the irradiation region 32 of irradiation apparatus 30 by conveyance system 39. Coating station 35 is positioned between irradiation region 32 and the upstream portion 39*a* of conveyance system 39 for continuously coating the outer surfaces of article 28 with the desired coating. Since the coating station 35 is downstream from the upstream portion 39*a* of conveyance system 39, the coated article 28 does not come in contact with the conveyance system 39 before reaching the irradiation region 32. This allows the article 28 to reach the irradiation region 32 with a consistent coating. When the coated article 28 passes through irradiation region 32, the beams 25 of electrons $e^-$ (FIG. 1) generated by electron beam emitters 26 treat the coated outwardly exposed surfaces of article 28. The electron beam emitters 26 of electron emitter system 31 are adjusted inwardly or outwardly relative to article 28 and irradiation region 32 in the direction of arrows 34 so that the coated surfaces of article 28 are the proper distance from electron beam emitters 26 for receiving sufficient electron $e^-$ radiation (for example, 0.75 to 1.25 inches when operating at 120 kV). If required, the electron beam emitters 26 are also adjusted rotationally around article 28 about center C to better orient the electron beam emitters 26 relative to the outer surfaces of article 28. When the electrons $e^-$ treat the coated surfaces of article 28 continuously passing through irradiation region 32, the electrons $e^-$ cause the cross linking or polymerization of the coating which rapidly cures and hardens the coating on the article 28. Consequently, by the time article 28 passes through the downstream portion 39*b* of conveyance system 39, the coating on article 28 typically does not experience damage from the downstream portion 39*b*. In an alternate use, irradiation apparatus 30 can be employed for sterilizing article 28 where the beams 25 of electrons kill or disable microorganisms on article 28. In such a case, coating station 35 is either omitted or is not operated. Additionally, irradiation apparatus 30 can be employed for surface modification of the outer surfaces of article 28 in order to obtain, for example, oxidation, passivation, nitriding, etc.

Figure 3:
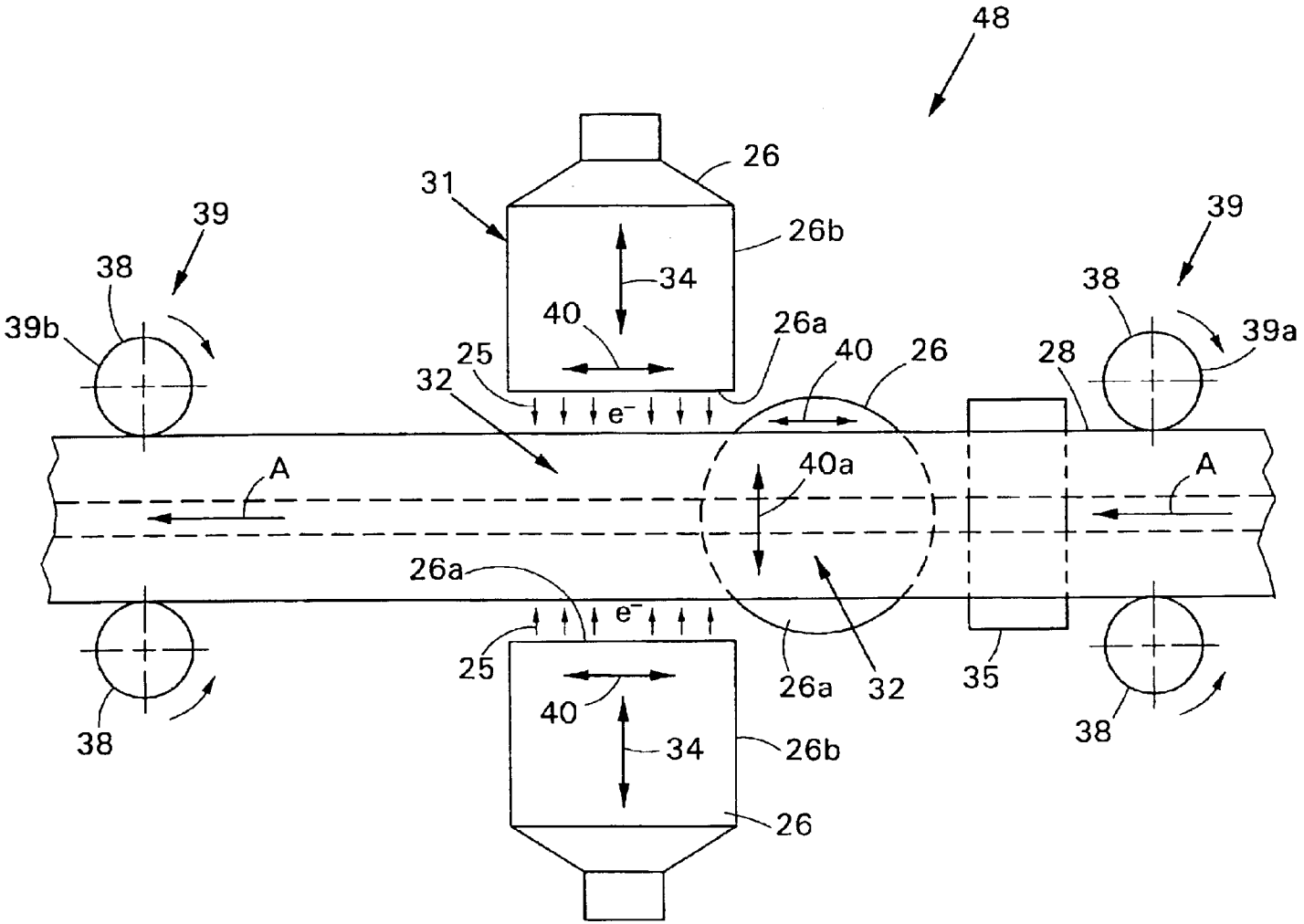
FIG. 3 is a side schematic view of another embodiment of an electron beam irradiation apparatus with one of the electron beam emitters omitted for clarity.

Referring to FIG. 3, electron beam irradiation apparatus 48 is another embodiment of the present invention which differs from the irradiation apparatus 30 in that irradiation apparatus 48 has two opposed pairs of electron beam emitters 26 which are offset from each other along the longitudinal direction of article 28. This allows the electron beam emitters 26 to be brought further into irradiation region 32 and closer to the surfaces of article 28, thereby providing better adjustability. An article 28 passing through irradiation region 32 is irradiated on two opposed sides when passing between the first pair of opposed electron beam emitters 26 and then irradiated on two more opposed sides when passing between the second pair of opposed electron beam emitters 26. Consequently, instead of simultaneously irradiating all surfaces of article 28, irradiation region 32 progressively sequentially irradiates the surfaces of article 28. Electron beam emitters 26 may be provided with adjustability in the direction of arrows 40 (longitudinally relative to article 28). Alternatively, electron beam emitters 26 can also be provided with adjustability laterally relative to article 28, as shown by arrow 40*a* for centering emitters 26 relative to article 28.

Figure 4:
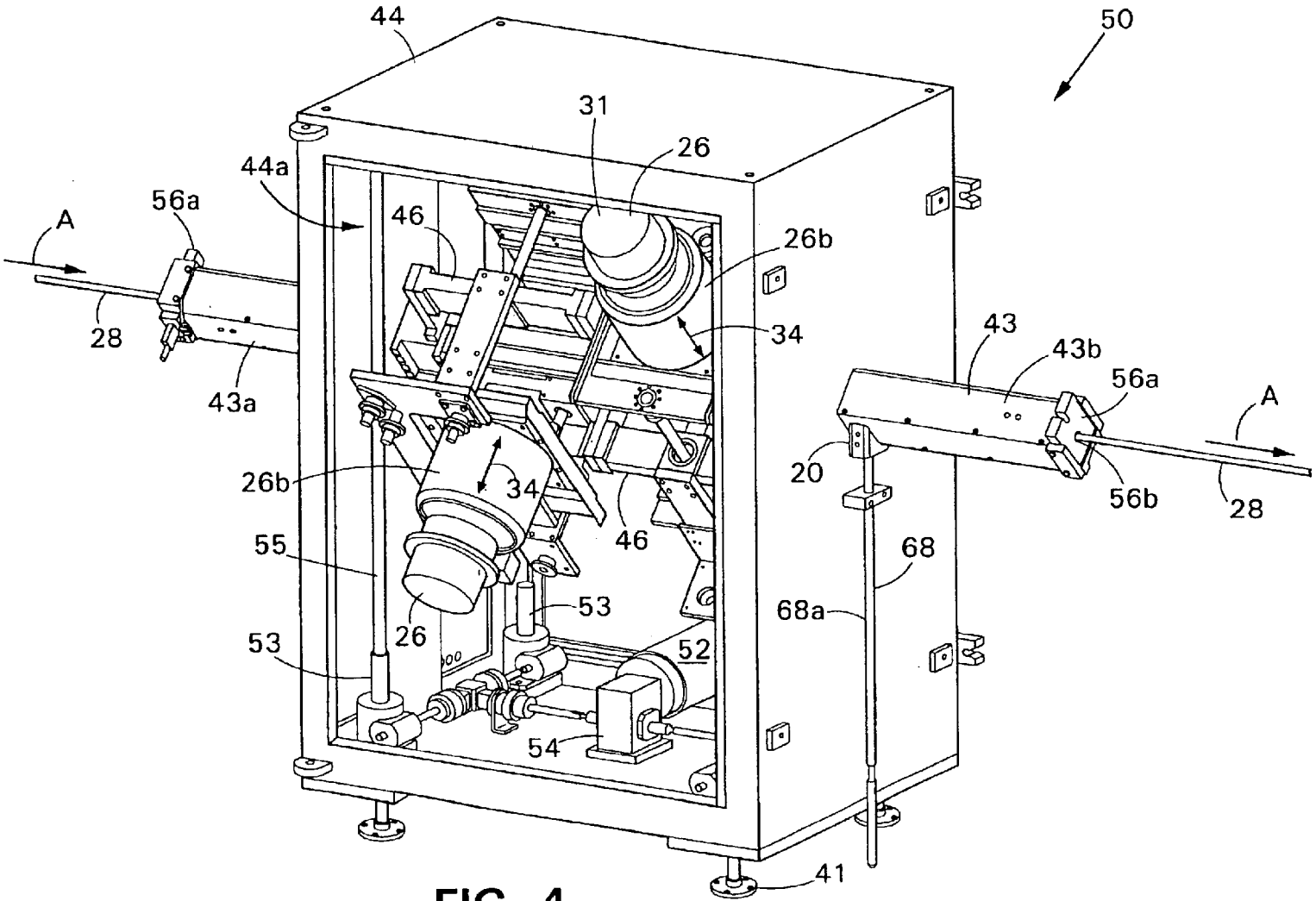
FIG. 4 is a rear perspective view of yet another embodiment of an electron beam irradiation apparatus having a housing with a rear access door removed for clarity.
Figure 5:
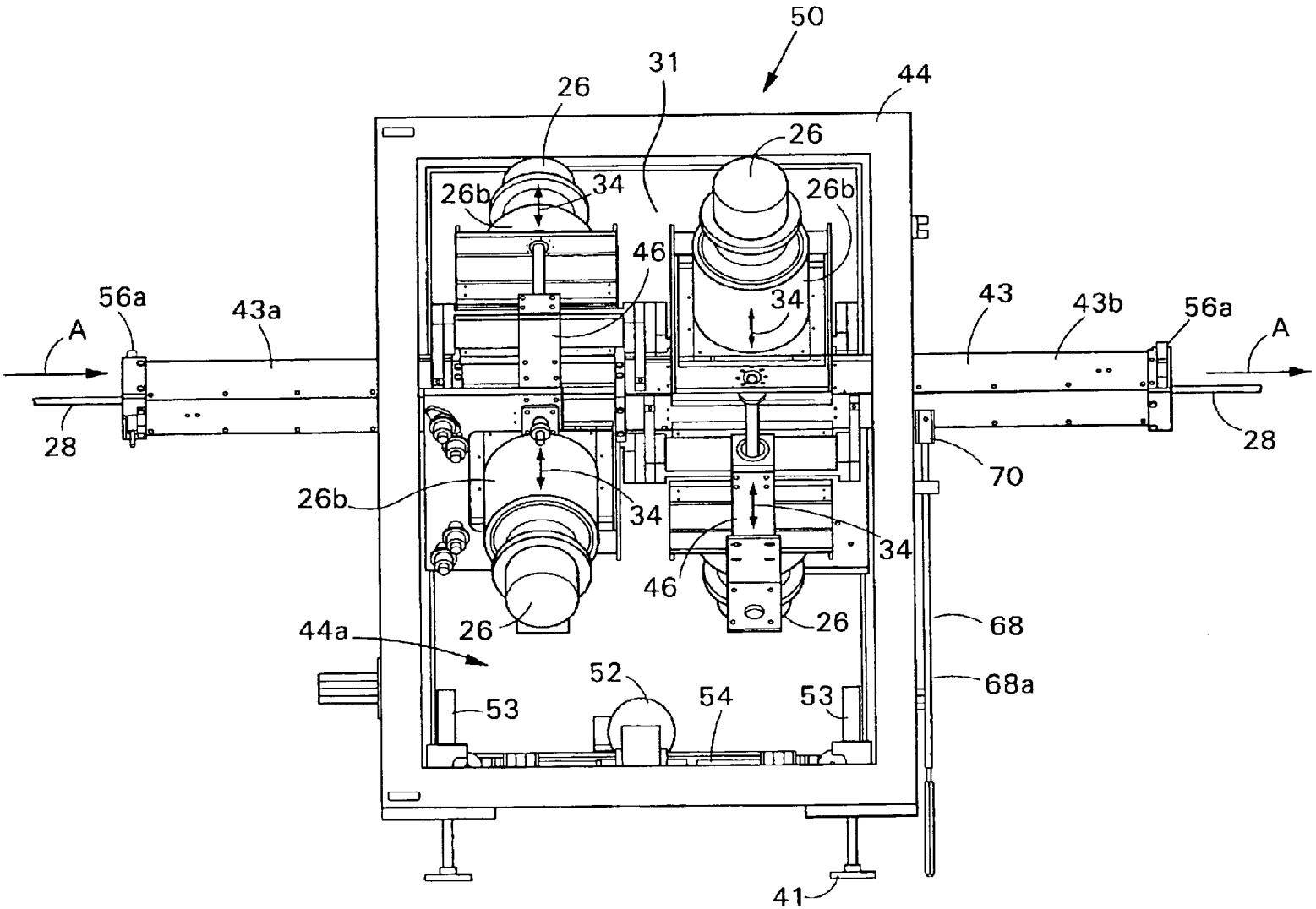
FIG. 5 is a rear side view of the electron beam irradiation apparatus of FIG. 4 with the rear access door removed.

Referring to FIGS. 4 and 5, irradiation apparatus 50 is another embodiment of the present invention. Irradiation apparatus 50 includes an outer housing 44. When employed for curing coatings on an article 28, housing 44 is positioned downstream from a coating station 35. An electron beam emitter system 31 having four electron beam emitters 26 is positioned within the interior 44*a* of housing 44. The housing 44 provides shielding from radiation from the electron beam emitters 26. The radiation can include both electron beam radiation as well as X-ray radiation formed from the electrons $e^-$. The four electron beam emitters 26 of electron beam emitter system 31 are positioned within the interior 44*a* of housing 44 in two opposed pairs that are mounted to a tunnel 43 extending through the housing 44. Article 28 is able to continuously pass through housing 44 by entering housing 44 through the upstream portion 43*a* of tunnel 43 and exiting through downstream portion 43*b*. The irradiation region 32 is contained within the tunnel 43 between the electron beam emitters 26. The two opposed pairs of electron beam emitters 26 are offset from or adjacent to each other along the longitudinal direction of tunnel 43. The longitudinal axes of the opposed pairs of the electron beam emitters 26 are shown positioned at inclined angles, for example, 45°, with the two pairs being at right angles to each other. Alternatively, the two pairs of electron beam emitters 26 can be oriented at other angles, such as horizontally and vertically, respectively.

Tunnel 43 includes two end plates 56*a* with openings 56*b* therethrough located at the upstream 43*a* and downstream 43*b* portions for allowing the passage of article 28. The combination of tunnel 43 and end plates 56*a* provides further radiation shielding as well as allows an inert gas such as nitrogen to be introduced and contained within the irradiation region 32 to aid in the curing process during irradiation. Openings 56*b* are preferably sized to be only slightly larger than the cross section of article 28 so that maximum radiation shielding and nitrogen gas retention can be provided.

Housing 44 includes a series of feet 41 for raising and lowering housing 44 in order to accommodate height variations of different sized articles 28. A motor 52 and a drive transmission 54 are located at the bottom of housing 44 for driving a series of bushings 53 that are secured to the housing 44. This raises and lowers the bushings 53 relative to a series of respective threaded foot columns 55 that are vertically fixed to the floor or ground below housing 44, which in turn raises and lowers housing 44.

A conveyance assembly 68 having a roller assembly 70 with a guide/idler roller extending into the downstream portion 43*b* of tunnel 43 contacts the article 28 after leaving irradiation region 32. The conveyance assembly 68 has a vertical member 68*a* in contact with the ground or floor for maintaining the guide/idler roller at the same height regardless of the height of housing 44. Consequently, the bottom surface of different sized articles 28 can always pass through housing 44 at the same height from the floor, while the amount of elevation of the housing 44 is adjusted to accommodate the height of the top part of the different sized articles 28.

Figure 6:
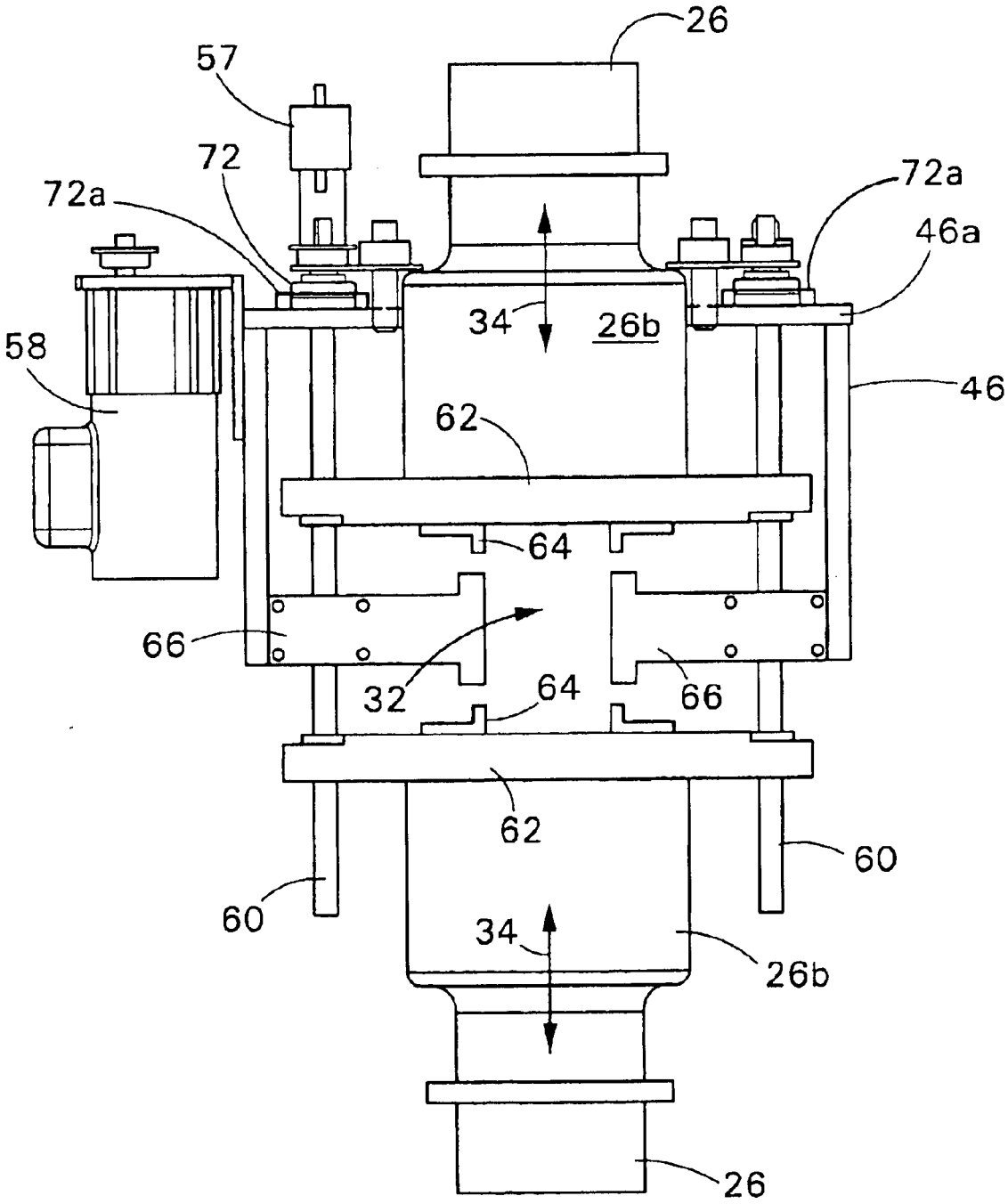
FIG. 6 is a side view of an opposed pair of electron beam emitters mounted to an adjustment fixture.

The electron beam emitter system 31 also includes two adjustment fixtures 46. The electron beam emitters 26 are mounted to the adjustment fixtures 46 which provide linear adjustment or movement of the emitters 26 in the direction of arrows 34, towards or away from irradiation region 32 in order to accommodate articles 28 of different shapes, orientations and sizes, as well as different heights of housing 44. Referring to FIG. 6, each adjustment fixture 46 includes a frame 46*a* having a pair of mounting plates 62 to which the vacuum chambers 26*b* of an opposed pair of electron beam emitters 26 are mounted. The mounting plates 62 are connected to each other and to one end of frame 46*a* by two threaded adjusting rods 60 located on opposite sides of the electron beam emitters 26. The adjusting rods 60 are driven by a motor 58 and a drive system 72. The drive system 72 includes two drive portions 72*a* that are connected together by a drive pulley or chain (not shown), each for driving or rotating a separate adjusting rod 60. Rotation of the adjusting rods 60 in one direction moves the electron beam emitters 26 closer together and, in the other direction, farther apart. An encoder 57 determines the relative positions of electron beam emitters 26. The frame 46*a* also includes mounting brackets 66 for mounting the adjustment fixture 46 and electron beam emitters 26 to the tunnel 43. The tunnel 43 is configured to be open in the regions corresponding to the exit windows 26*a* of the electron beam emitters 26 in order to allow the entrance of the beams 25 of electrons $e^-$ into the irradiation region 32. If the exit windows 26*a* are designed to emit electrons $e^-$ in a rectangular configuration, the exit windows 26*a* are typically oriented so that the long direction of the rectangular configuration extends in the longitudinal direction of the tunnel 43 so that the length of irradiation region 32 is maximized.

A series of shields 64 are mounted to each mounting plate 62 for engaging the openings into the tunnel 43 for radiation shielding as well as preventing inert gases from escaping tunnel 43 when inert gases are employed. The shields 64 extend forwardly relative to the exit window 26*a* to allow for adjustment of the electron beam emitters 26 towards or away from irradiation region 32 while continuing to provide shielding.

Although FIG. 6 depicts a single motor 58 for simultaneously moving two electron beam emitters 26, alternatively, each electron beam emitter 26 can be provided with a motor and moved independently of each other. In addition, adjustment fixture 46 can include features to provide some or all of the other adjustments contemplated for irradiation apparatuses 30 and 48. Curing of coatings at high speed can be performed with irradiation apparatus 50, with 300–1000 feet per minute being a typical speed. In one embodiment, the width or height of article 28 can range between ½ to 3¼ inches. It is understood that the dimensions of article 28 can vary, and that the dimensions of irradiation apparatus 50 are sized to accommodate the dimensions of article 28.

The size and power of electron beam emitters 26 for irradiation apparatuses 30, 48 and 50 can be chosen to suit the particular application at hand (speed, size, type of coating, etc.). Article 28 does not have to be generally rectangular in shape and can be curved, round, triangular, polygonal, complex combinations thereof, etc. Article 28 can be either hollow or solid and can be made by typical continuous processes involving, for example, extrusion, continuous casting, bending, bending and welding, etc. In addition, the electron beam emitter system 31 can have less than or more than four electron beam emitters 26 depending upon the application at hand. Furthermore, the emitters 26 do not have to be at right angles to each other. This most often occurs when fewer than four or more than four electron beam emitters 26 are employed. When irradiating articles 28 that have round or triangular cross sections, three electron beam emitters 26 can be employed. Opposed electron beam emitters 26 in some situations can be in axial or angular misalignment. Although the embodiments of FIGS. 1–6 have been mainly described for curing coatings on 3-dimensional articles, alternatively, such embodiments can be employed for irradiating a moving 2-dimension web, as well as be employed for sterilization or surface modification purposes. When employed for sterilization or surface modification purposes, the coating station 35 can be omitted. Also, when irradiating a 2-dimensional web, only two opposed electron beam emitters 26 need to be operating.

Figure 7:
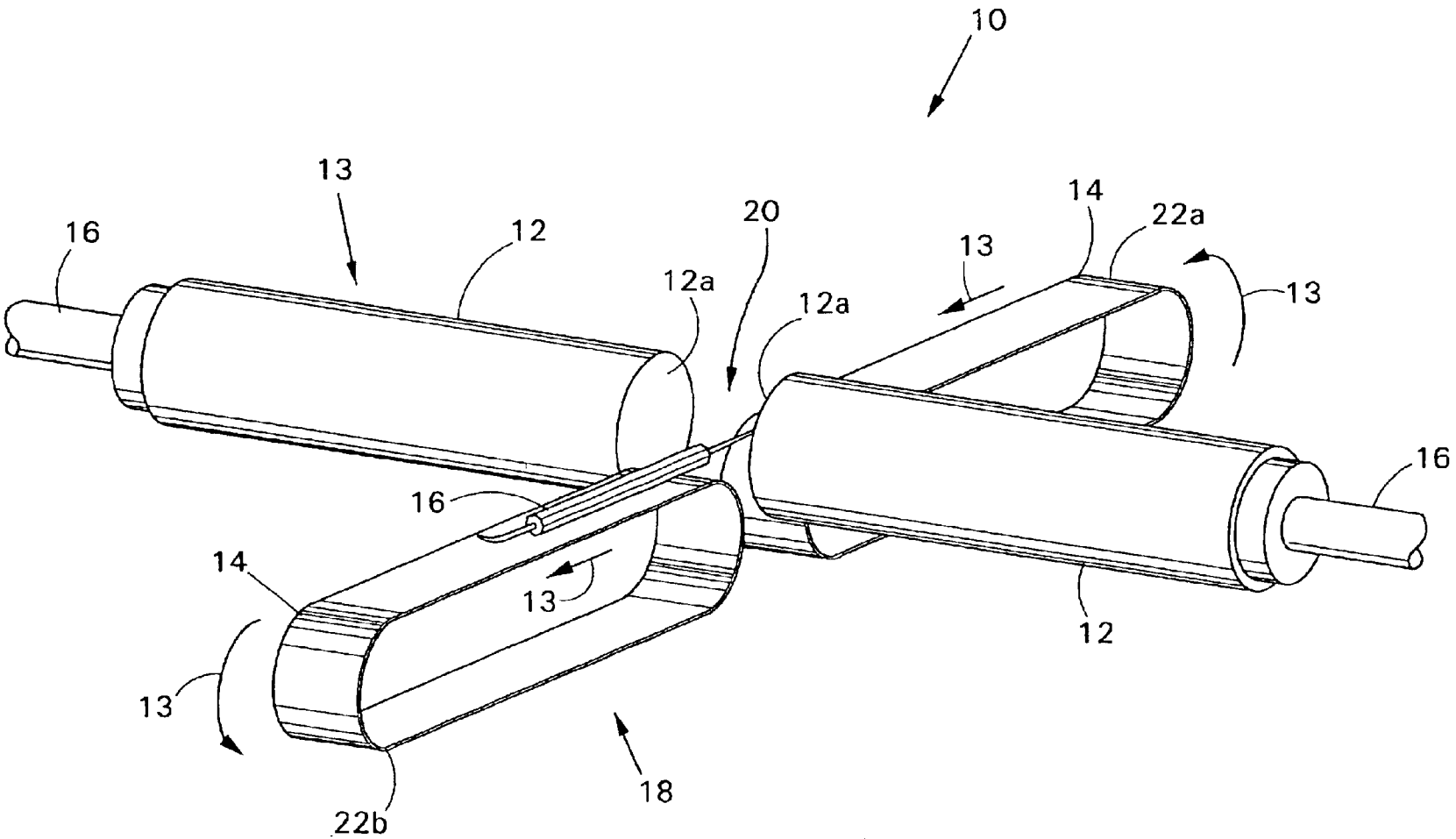
FIG. 7 is a perspective schematic view of still another embodiment of an electron beam irradiation apparatus.
Figure 8:
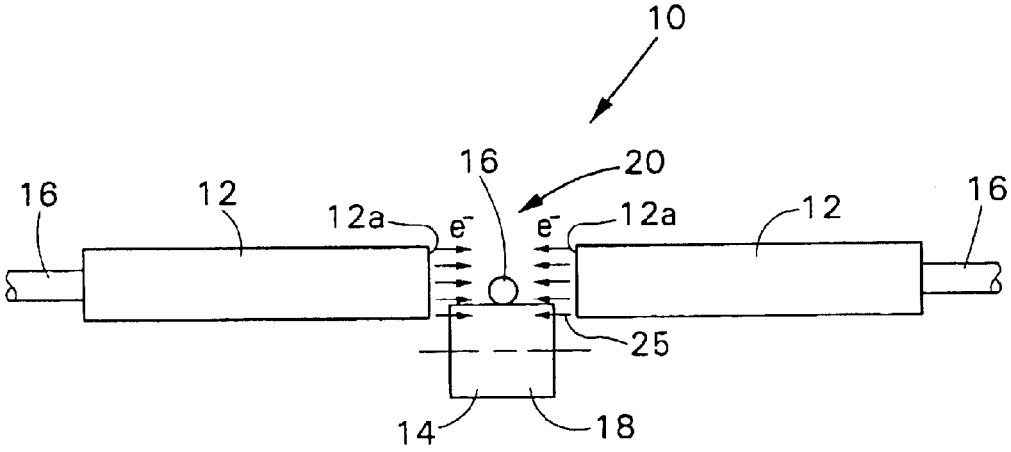
FIG. 8 is an end schematic view of the electron beam irradiation apparatus of FIG. 7.

Referring to FIG. 7, electron beam irradiation apparatus 10 is still another embodiment of the present invention that is suitable for sterilizing 3-dimensionally shaped articles 16, for example, medical instruments such as dental or surgical instruments. Irradiation apparatus 10 includes an electron beam emitter system 13 having two electron beam emitters 12. The electron beam exit windows 12*a* of electron beam emitters 12 face each other and are axially aligned with each other on opposite sides of a gap forming an irradiation/sterilization region or zone 20 therebetween. The electron beam emitters 12 direct opposing beams 25 of electrons $e^-$ into the irradiation region 20 (FIG. 8). Power to the electron beam emitters 12 is provided through cables 16. A conveyance system 18 conveys articles 16 through the irradiation region 20 and through the opposing beams 25 of electrons $e^-$ for sterilization. The conveyance system 18 includes first 22*a* and second 22*b* conveyors, each having an endless belt 14 that is driven around rollers or pulleys 24 (FIG. 9) in the direction of the arrows 13 by the rotation of the pulleys 24 in the direction of arrows 11. The conveyors 22*a*/22*b* are spaced apart from each other in the region of irradiation region 20 so as not to block the beams 25 of electrons $e^-$. This allows articles 16 to be fully sterilized while passing through sterilization region 20.

Figure 9:
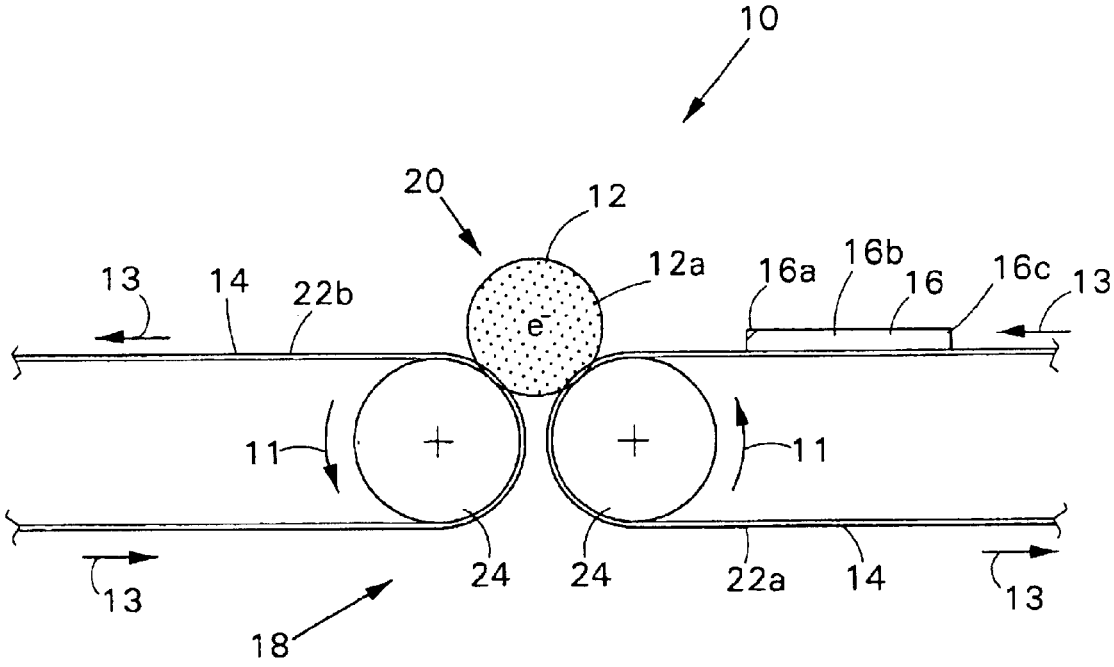
FIGS. 9–11 are side schematic views of the electron beam irradiation apparatus of FIG. 7 with one electron beam emitter omitted for clarity with an article being conveyed by the conveyance system and depicted at various stages of movement along the conveyance system.
Figure 10:
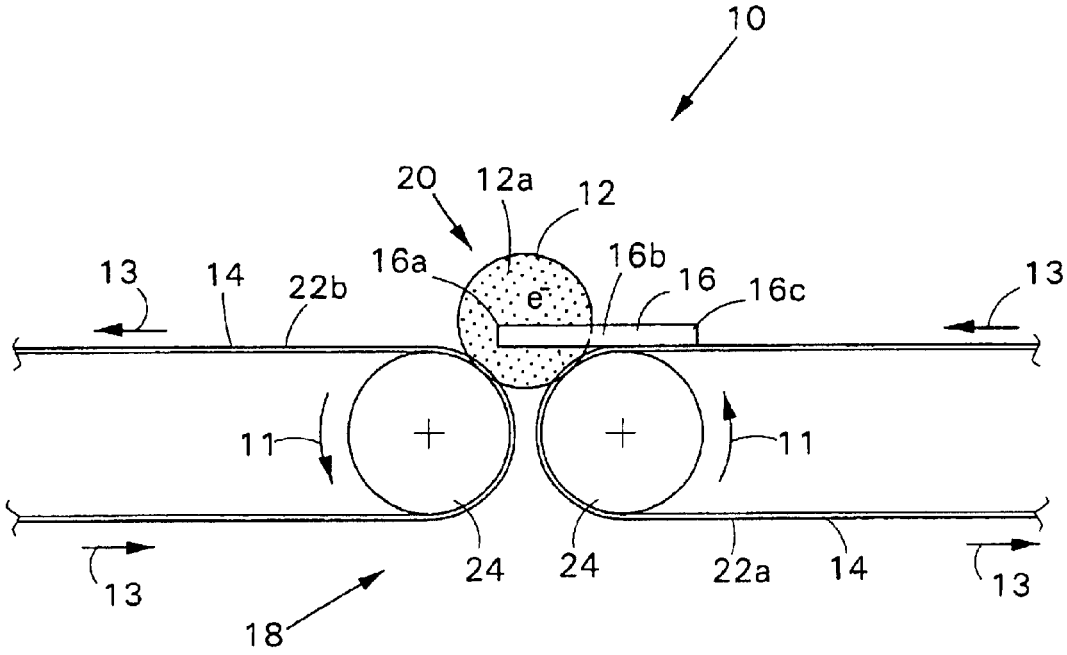
Figure 11:
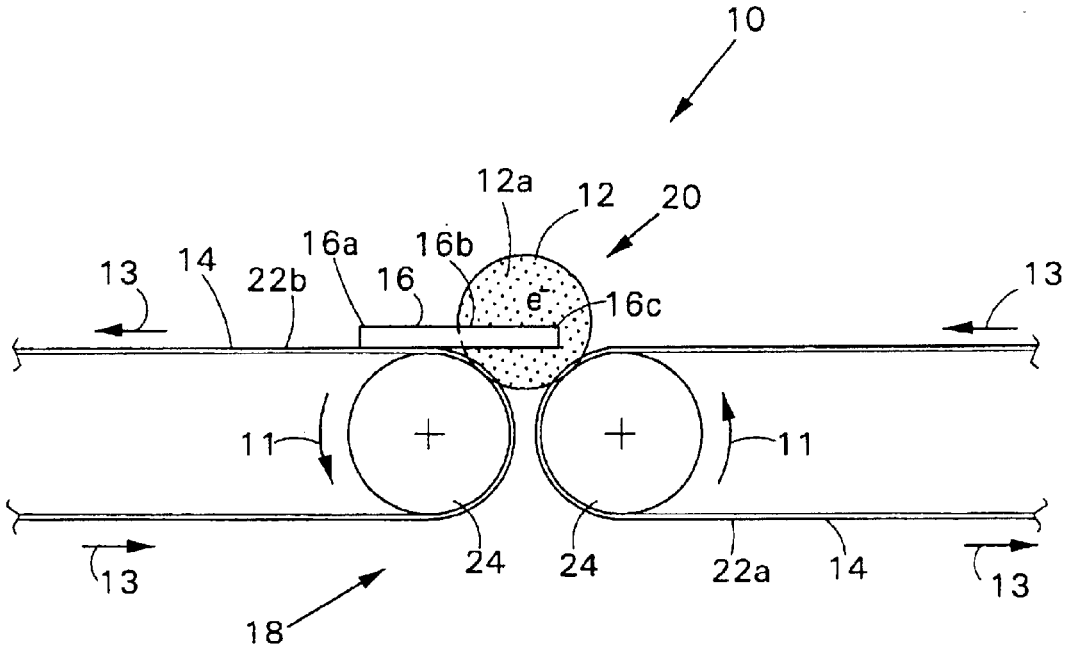

In use, the power to electron beam emitters 12 is turned on and two opposing beams 25 of electrons $e^-$ are directed into irradiation region 20 by the electron beam emitters 12. The conveyance system 18 is turned on and the belts 14 of conveyors 22*a*/22*b* are driven around pulleys 24. An article 16 to be sterilized is placed upon the belt 14 of the first conveyor 22*a* (FIG. 9). The first conveyor 22*a* moves article 16 into the sterilization region 20. As the tip 16*a* of article 16 reaches the end of the first conveyor 22*a*, the tip 16*a* extends off the end of the first conveyor 22*a* into the irradiation region 20 (FIG. 10). Since the tip 16*a* is no longer resting on a belt 14 which could block some of the sterilizing electrons $e^-$, the beams 25 of electrons $e^-$ are able to fully sterilize all surfaces of tip 16*a*. After the tip 16*a* passes through the irradiation region 20, the tip 16*a* reaches the second conveyor 22*b*. The mid-section 16*b* and rear end 16*c* of article 16 follow tip 16*a* and pass from the first conveyor 22*a* through irradiation region 20, thereby becoming sterilized before reaching the second conveyor 22*b* (FIG. 11). The second conveyor 22*b* then conveys article 16 away from irradiation region 20.

In most cases, the articles 16 are typically instruments that are relatively small in cross section so that electron beam emitters 12 which provide a 2-inch diameter beam 25 of electrons $e^-$ is usually sufficient. Alternatively, larger or smaller electron beam emitters 12 may be employed depending upon the application at hand. In addition, if required, more than two electron beam emitters 12 can be employed. Such an arrangement can direct a beam 25 of electrons $e^-$ from multiple directions. The electron beam emitters 12 can be angled forwardly or rearwardly, or axially offset. Furthermore, each electron beam emitter 12 can be adjustable up or down, towards or away from the irradiation region 20, rotatably about irradiation region 20, or at angles. Although irradiation apparatus 10 is typically employed for sterilizing articles 16 that are relatively short in length, alternatively, irradiation apparatus 10 can be employed for sterilizing a single continuously moving article, or can be employed for curing coatings or obtaining surface modification. The conveyance system 18 can be modified to suit the application at hand. For example, the conveyors 22*a*/22*b* can be moved farther apart from each other or replaced with rollers.

While this invention has been particularly shown and described with references to preferred embodiments thereof, it will be understood by those skilled in the art that various changes in form and details may be made therein without departing from the scope of the invention encompassed by the appended claims. For example, features of the various embodiments disclosed may be combined or omitted. In addition, although conveyance systems with rollers or conveyor belts have been described, alternatively, the conveyance systems can include components for dropping articles through the irradiation zone by gravity. In such a case, the electron beam system would be configured appropriately. Reflectors can be employed for reflecting electrons $e^-$ to aid in the irradiation of articles in the irradiation region. In some cases, some of the electron beam emitters can be replaced with reflectors. Furthermore, the configuration, size and dimensions of various components of the irradiation apparatuses of the present invention are understood to vary depending upon the size and shape of the article to be irradiated. The articles can have varying surfaces or structures, and do not need to be smooth.

What is claimed is:

1. An electron beam irradiation apparatus comprising an electron beam system for directing electrons into an irradiation zone, the electron beam system and the irradiation zone being configured for irradiating outwardly exposed surfaces of a 3-dimensional article passing through the irradiation zone from different directions with electrons from the electron beam system, the electron beam system comprising multiple electron beam emitters having at least one opposed pair of electron beam emitters which are positioned to irradiate the irradiation zone with electrons; and an adjustment system capable of moving the electron beam emitters for changing the position of the electron beam emitters relative to the article.

2. The apparatus of claim 1 in which the adjustment system is capable of moving the electron beam emitters towards or away from the irradiation zone.

3. The apparatus of claim 2 in which the adjustment system is capable of rotating the electron beam emitters about the irradiation zone.

4. The apparatus of claim 3 in which the adjustment system includes an adjustable rotating mechanism capable of rotating the electron beam emitters about the irradiation zone.

5. The apparatus of claim 3 in which the electron beam system comprises four electron beam emitters.

6. The apparatus of claim 5 in which the electron beam emitters are positioned in first and second opposed pairs.

7. The apparatus of claim 6 in which the second opposed pair is downstream from the first opposed pair.

8. The apparatus of claim 2 in which the adjustment system includes an adjustable linear mechanism capable of moving the electron beam emitters towards or away from the irradiation zone.

9. The apparatus of claim 1 further comprising a conveyance system for conveying the article through the irradiation zone, the conveyance system being configured to allow the article to be irradiated with electrons on the outwardly exposed surfaces.

10. The apparatus of claim 9 in which the article is a continuous profile, the conveyance system including at least one roller positioned beyond the irradiation zone for conveying the profile through the irradiation zone.

11. The apparatus of claim 1 in which the apparatus cures coatings on said surfaces of the article.

12. The apparatus of claim 1 in which the apparatus sterilizes said surfaces of the article.

13. The apparatus of claim 1 in which the apparatus provides surface modification of said surfaces of the article.

14. The apparatus of claim 1 in which the electron beam system provides electrons from opposing directions.

15. The apparatus of claim 14 in which the electron beam system comprises two opposed electron beam emitters separated from each other by a gap.

16. The apparatus of claim 15 in which the conveyance system comprises two conveyor belts for conveying the article between the opposed electron beam emitters through the gap therebetween, the conveyor belts being spaced apart from each other in tho region of the gap so that the article passing between the electron beam emitters can be frilly irradiated by the electrons.

17. An electron beam irradiation apparatus for curing coatings on a continuously moving 3-dimensional profile comprising:

an electron beam system for directing electrons into an irradiation zone, the electron beam system and the irradiation zone being configured for irradiating outwardly exposed surfaces of the profile passing through the irradiation zone with electrons from the electron beam system for curing coatings thereon, the electron beam system including multiple electron beam emitters having at least one opposed pair of electron beam emitters which are positioned to irradiate the irradiation zone with electrons each from a different direction; and an adjustment system capable of moving the electron beam emitters for changing the position of the electron beam emitters relative to the article.

18. An electron beam irradiation apparatus for sterilizing a 3-dimensional article comprising an electron beam system for directing electrons into an irradiation zone, the electron beam system and the irradiation zone being configured for irradiating outwardly exposed surfaces of the 3-dimensional article passing through the irradiation zone from different directions with electrons from the electron beam system to sterilize said surfaces, the electron beam system comprising multiple electron beam emitters having at least one opposed pair of electron beam emitters which are positioned to irradiate the irradiation zone with electrons; and an adjustment system capable of moving the electron beam emitters for changing the position of the electron beam emitters relative to the article.

19. An electron beam irradiation apparatus comprising:

an electron beam system comprising multiple electron beam emitters having at least one opposed pair of electron beam emitters for directing electrons into an irradiation zone, the electron beam system and the irradiation zone being configured for irradiating an article passing through the irradiation zone with electrons from the electron beam system; and an adjustment system capable of moving the electron beam emitters for changing the position of the electron beam emitters relative to the article.

20. The apparatus of claim 19 in which the adjustment system is capable of moving the electron beam emitters towards or away from the irradiation zone.

21. The apparatus of claim 20 in which the adjustment system is capable of rotating the electron beam emitters about the irradiation zone.

22. A method of forming an electron beam apparatus comprising:

providing an electron beam system for directing electrons into an irradiation zone;

configuring the electron beam system and the irradiation zone for irradiating outwardly exposed surfaces of a 3-dimensional article passing through the irradiation zone from different directions with electrons from the electron beam system, the electron beam system comprising multiple electron beam emitters having at least one opposed pair of electron beam emitters which are positioned to irradiate the irradiation zone with electrons; and providing an adjustment system capable of moving the electron beam emitters for changing the position of the electron beam emitters relative to the article.

23. The method of claim 22 further comprising providing the adjustment system with the capability of moving the electron beam emitters towards or away from the irradiation zone.

24. The method of claim 23 further comprising providing the adjustment system with the capability of rotating the electron beam emitters about the irradiation zone.

25. The method of claim 24 further comprising providing the adjustment system with an adjustable rotating mechanism capable of rotating the electron beam emitters about the irradiation zone.

26. The method of claim 23 further comprising providing the adjustment system with cm adjustable linear mechanism capable of moving the electron beam emitters towards or away from the irradiation zone.

27. The method of claim 23 further comprising providing the electron beam system with four electron beam emitters.

28. The method of claim 27 further comprising positioning the electron beam emitters in first and second opposed pairs.

29. The method of claim 28 further comprising positioning the second opposed pair downstream from the first opposed pair.

30. The method of claim 22 further comprising providing a conveyance system for conveying the article through the irradiation zone, the conveyance system being configured to allow the article to be irradiated with electrons on the outwardly exposed surfaces.

31. The method of claim 30 in which the article is a continuous profile, the method further comprising providing the conveyance system with at least one roller positioned beyond the irradiation zone for conveying the profile through the irradiation zone.

32. The method of claim 22 further comprising configuring the apparatus for curing coatings on said surfaces of the article.

33. The method of claim 22 further comprising configuring the apparatus for sterilizing said surfaces of the article.

34. The method of claim 22 further comprising configuring the apparatus for providing surface modification of said surfaces of the article.

35. The method of claim 22 further comprising providing electrons from opposing directions.

36. The method of claim 35 further providing the electron beam system with two opposed electron beam emitters separated from each other by a gap.

37. The method of claim 36 further comprising providing the conveyance system with the two conveyor belts for conveying the article between the opposed electron beam emitters through the gap therebetween, the conveyor belts being spaced apart from each other in the region of the gap so that the article passing between the electron beam emitters can be fully irradiated by the electrons.

38. A method of forming an electron beam apparatus comprising:

providing an electron beam system comprising multiple electron beam emitters having at least one opposed pair of electron beam emitters for directing electrons into an irradiation zone;

configuring the electron beam system and the irradiation zone for irradiating an article passing through the irradiation zone with electrons from the electron beam system and providing an adjustment system capable of moving the electron beam emitters for changing the position of the electron beam emitters relative to the article.

39. The method of claim 38 further comprising providing the adjustment system with the capability of moving the electron beam emitters towards or away from the irradiation zone.

40. The method of claim 39 further comprising providing the adjustment system with the capability of rotating the electron beam emitters about the irradiation zone.

41. A method of curing coatings on a continuously moving 3-dimensional profile comprising:

directing electrons from an electron beam system into an irradiation zone;

passing the profile through the irradiation zone, the electron beam system and the irradiation zone being configured for irradiating outwardly exposed surfaces of the profile with electrons from the electron beam system for curing coatings thereon, the electron beam system including multiple electron beam emitters having at least one opposed pair of electron beam emitters which are positioned to irradiate the irradiation zone with electrons each from a different direction; and moving the electron beam emitters for positioning the electron beam emitters in the proper position relative to the article with an adjustment system.

42. A method of sterilizing a moving 3-dimensional article comprising:

directing electrons from an electron beam system into an irradiation zone;

passing the 3-dimensional article through the irradiation zone, the electron beam system and the irradiation zone being configured for irradiating outwardly exposed surfaces of the 3-dimensional article from different directions with electrons from the electron beam system to sterilize said surfaces, the electron beam system comprising multiple electron beam emitters having at least one opposed pair of electron beam emitters which are positioned to irradiate the irradiation zone with electrons; and providing an adjustment system capable of moving the electron beam emitters for changing the position of the electron beam emitters relative to the article.

43. A method of irradiating an article comprising:

directing electrons from an electron beam system into an irradiation zone, the electron beam system comprising multiple electron beam emitters having at least one opposed pair of electron beam emitters;

introducing the article into the irradiation zone, the electron beam system and the irradiation zone being configured for irradiating the article with electrons from the electron beam system; and moving the electron beam emitters for positioning the electron beam emitters in the proper position relative to the article with an adjustment system.

44. A method of irradiating a moving 3-dimensional article comprising:

directing electrons from an electron beam system into an irradiation zone; and passing the 3-dimensional article through the irradiation zones the electron beam system and the irradiation zone being configured for irradiating outwardly exposed surfaces of the 3-dimensional article from different directions with electrons from the electron beam system, the electron beam system comprising multiple electron beam emitters having at least one opposed pair of electron beam emitters which are positioned to irradiate the irradiation zone with electrons; and providing an adjustment system capable of moving the electron beam emitters for changing the position of the electron beam emitters relative to the article.

45. An electron beam irradiation apparatus comprising:

an electron beam system comprising a plurality of electron beam emitters generally surrounding an irradiation zone for directing electrons into the irradiation zone, the electron beam system and the irradiation zone being configured for irradiating an article passing through the irradiation zone with electrons from the electron beam system; and an adjustment system capable of moving the electron beam emitters for changing the position of the electron beam emitters relative to the article.

46. The apparatus of claim 45 in which the electron beam system includes three electron beam emitters positioned around the irradiation zone.

* * * * *

UNITED STATES PATENT AND TRADEMARK OFFICE

CERTIFICATE OF CORRECTION

PATENT NO. : 6,833,551 B2
APPLICATION NO. : 10/097192
DATED : December 21, 2004
INVENTOR(S) : Tzvi Avnery It is certified that error appears in the above-identified patent and that said Letters Patent is hereby corrected as shown below:

Column 8,
Line 62, delete “tho” and insert -- the --.
Line 63, delete “frilly” and insert -- fully --.

Column 10,
Line 6, delete “cm” and insert -- an --.
Line 55, insert a semicolon -- ; -- after “system”.

Column 12,
Line 12, delete “zones” and insert -- zone, --.

Signed and Sealed this

Twenty-seventh Day of June, 2006

JON W. DUDAS
*Director of the United States Patent and Trademark Office*